United States Patent [19]

Barbe et al.

[11] 4,117,194

[45] Sep. 26, 1978

[54] BICOMPONENT FILAMENTS WITH A SPECIAL CROSS-SECTION

[75] Inventors: Gerard Barbe, Craponne; Robert Habault, Lyons, both of France

[73] Assignee: Rhone-Poulenc-Textile, Paris, France

[21] Appl. No.: 707,242

[22] Filed: Jul. 21, 1976

Related U.S. Application Data

[63] Continuation-in-part of Ser. No. 559,421, Mar. 18, 1975, Pat. No. 3,973,073, which is a continuation of Ser. No. 356,576, May 2, 1973, abandoned.

[30] Foreign Application Priority Data

Feb. 27, 1976 [FR] France ..... 76 05791
May 4, 1972 [FR] France ..... 72.16921

[51] Int. Cl.[2] ..... D02G 3/00

[52] U.S. Cl. ..... 428/374; 264/171; 428/370; 428/371; 428/397

[58] Field of Search ..... 428/373, 374, 397, 370, 428/371; 264/171

[56] References Cited

U.S. PATENT DOCUMENTS

| | | | |
|---|---|---|---|
| 3,671,379 | 6/1972 | Evans et al. | 428/373 X |
| 3,718,534 | 2/1973 | Okamoto et al. | 428/397 X |
| 3,973,073 | 8/1976 | Barbe et al. | 428/394 X |

*Primary Examiner*—Lorraine T. Kendell
*Attorney, Agent, or Firm*—Murray & Whisenhunt

[57] ABSTRACT

Side-by-side bicomponent polyester filaments, and process for making same, are disclosed, wherein the filaments are of polyethylene terephthalate and polybutylene terephthalate, with the polybutylene terephthalate being sparingly cross-linked by at least about 0.20 mole per cent of cross-linking agent. The sparingly cross-linked polybutylene terephthalate has a melted state viscosity VF of at least about 2000 poises at 260° C. The polyethylene terephthalate partly envelopes the sparingly cross-linked polybutylene terephthalate, in cross-section, so as to cover at least about 45% of the periphery of the sparingly cross-linked polybutylene terephthalate.

5 Claims, 3 Drawing Figures

BICOMPONENT FILAMENTS WITH A SPECIAL CROSS-SECTION

CROSS-REFERENCE TO RELATED APPLICATIONS

This application is a continuation-in-part of Ser. No. 559,421, filed Mar. 18, 1975 now U.S. Pat. No. 3,973,073 which was in turn a continuation of Ser. No. 356,576, filed May 2, 1973, and now abandoned.

BACKGROUND OF THE INVENTION

U.S. Pat. No. 3,973,073 discloses production of bicomponent polyester fibers in a side-by-side arrangement wherein the two polymeric components are polyethylene terephthalate and sparingly cross-linked polybutylene terephthalate. Conventional processes for obtaining the bicomponent fibers are utilized. The filaments of this copending application exhibit good crimp properties, when compared to the bicomponent polyester filaments produced previously, but the crimp properties are still not as high as desired, principally when the sparingly cross-linked polybutylene terephthalate used has a molten state viscosity VF between 3500–5500 poises at 260° C.

U.S. Pat. No. 3,671,379 to Evans, et al. discloses the production of laterally eccentric bicomponent filaments, wherein one of the polymeric components can be polytetramethylene terephthalate and the other polymeric component can be polyethylene terephthalate. Such yarns are helically crimpable, and the crimp potential is retained when the filament is annealed. The two melts flow through individual channels to the front fact of the spinneret, wherein they merge into a side-by-side composite filament as they leave the spinneret assembly.

British Pat. No. 514,638 discloses a process for producing bicomponent filaments wherein the filaments are spun through a spinning nozzle which comprises two parallel plates having multiple perforations therein. One plate forms the outer wall of the nozzle and the other plate, which is separated a relatively small distance apart from the first plate, divides the interior of the nozzle into two separate compartments. Each plate contains the same number of perforations, and the opposed perforations are coaxial with each other. The two liquids to be spun are supplied to separate compartments, with the first liquid extruded through the inner plate in the form of liquid streams or jets into the compartment filled with the second liquid, which is in turn extruded through the outer plate into a precipitating medium in such a manner that it drags with it the streams of the first liquid. The apparatus can be used to produce concentric layers of the spun substances, or by using baths having a powerful shrinking action, fibers of various cross-sections can be obtained, and the inner polymer may lie on the surface of the fibers.

The aforesaid British pat. No. 514,638 corresponds to French Pat. No. 837,555. French Pat. No. 50,780 is a third patent of addition to the aforesaid French Pat. No. 837,555. That patent of addition discloses that the distance between the two plates in the spinning nozzle can be varied to vary the configuration of the resulting filament. Furthermore, the opposed perforations can be displaced either radially or laterally, to also vary the characteristics of the resulting filaments. The working examples of this patent of addition relate to the first embodiment mentioned above, wherein the distance between the plates is varied to vary the filament properties, and no example discloses the radial or lateral displacement of the opposed perforations. That is, in the working examples of this third patent of addition, the opposed perforations are still substantially coaxial.

SUMMARY OF THE INVENTION

The present invention relates to side-by-side bicomponent polyester filaments, wherein one of the components is polyethylene terephthalate and the other component is a sparingly cross-linked polybutylene terephthalate polymer, having a molten state viscosity VF of at least 2000 poises at 260° C. The polyethylene terephthalate polymer partly envelopes the sparingly cross-linked polybutylene terephthalate polymer. The resulting bicomponent filaments exhibit improved crimp properties.

Filaments according to the present invention are obtained by using spinneret assembly, wherein jets of the polybutylene terephthalate polymer are introduced into a chamber filled with polyethylene terephthalate polymer. A mixture of the polymers is discharged from such chamber through a bore which is axially displaced from the axis of the jet of polybutylene terephthalate polymer, and which leads to a spinning orifice. Filaments of the same cross section as those according to the present invention can also be obtained by conventional melt spinning processes for side-by-side bicomponent filaments when using a cross linked polybutylene terephthalate of very high viscosity generally more than 8000 poises and preferably at least 10,000 poises at 260° C., but their crimp properties are generally not so good. By the term "side-by-side bicomponent filaments," we mean filaments made from two different components, each component having a surface in contact with the surrounding environment (that is, each component forms a part of the surface of the filament) throughout the length of the filament.

DETAILED DESCRIPTION OF THE INVENTION

Side-by-side polyester bicomponent filaments exhibit improved crimp properties if the filaments are made from poly(ethylene terephthalate) and sparingly cross-linked poly(butylene terephthalate), and if the sparingly cross-linked poly(butylene terephthalate) component is partly enveloped by the polyethylene terephthalate component. The polybutylene terephthalate component should have a molten state viscosity MV of at least 2000 poises at 260° C., and preferably the molten state viscosity of the sparingly cross-linked polybutylene terephthalate is at least equal to 4000 poises.

The sparingly cross-linked polybutylene terephthalate component will form a portion of the surface of the filament, and thus is not completely enveloped by the polyethylene terephthalate component. Normally at least 45% of the sparingly cross-linked polybutylene terephthalate component periphery will be covered by the polyethylene terephthalate component, and preferably about 50 to about 70% of the sparingly cross-linked polybutylene terephthalate component periphery is covered by the polyethylene terephthalate component. In no event should more than 95% of the periphery of the sparingly cross linked polybutylene terephthalate be covered by the polyethylene terephthalate.

The special spinneret assembly which can be used according to the present invention comprises a spinneret plate and a distribution plate, which is placed upstream of the spinneret plate. The distribution plate has a number of channels therethrough for the supply of sparingly cross-linked polybutylene terephthalate to the cavity between the distribution plate and the spinneret plate. The spinneret plate has an identical number of bores therein, which are larger in diameter than the diameter of the distribution plate channels, and which are located eccentrically in relation to the distribution plate channels. That is, the spinneret plate bores and the distribution plate channels are not coaxial. The distance between the axis of a given distribution plate channel and the axis of a corresponding spinneret plate bore is at least equal to the difference between the radius of the bore and the radius of the channel.

A polyethylene terephthalate component and a sparingly cross-linked polybutylene terephthalate component having a molten state viscosity VF of at least 2000 poises, preferably at least 4000 poises, at 260° C., are melt spun simultaneously through this special spinneret assembly. The two components are simultaneously introduced into the cavity between the spinneret plate and the distribution plate, with the sparingly cross-linked polybutylene terephthalate component being introduced in the form of a stream or jet which is passed through the distribution plate channels. Preferably the stream of sparingly cross-linked polybutylene terephthalate component impinges on a chamfer provided at the entry of the corresponding spinneret plate bore. The polyethylene terephthalate component is separately introduced into the cavity between the spinneret and the distribution plate, and envelopes the jets of sparingly cross-linked polybutylene terephthalate. The polyethylene terephthalate component may be fed to the space between the spinneret plate and the distribution plate by any conventional means, and for instance may suitably be introduced through orifices provided in the distribution plate, which are difference from the distribution plate channels which feed the sparingly cross-linked polybutylene terephthalate component. If such polyethylene terephthalate component feed channels are used, they will preferably have a diameter which is larger than the diameter of the channels in the distribution plate which are used to feed the sparingly cross-linked polybutylene terephthalate component.

As said before, a bicomponent filament with the same cross section as that according to the present invention can also be obtained by using a conventional melt spinning apparatus for side-by-side bicomponent filament such as those which are used in the parent application, Ser. No. 559,421, or in U.S. Pat. No. 2,386,173, the disclosures of which are hereby incorporated by reference, but only when using a cross-linked polybutylene terephthalate of very high viscosity.

The polyethylene terephthalate component used in the bicomponent filaments of the present invention generally has a molten state viscosity VF at 290° C. of between 1000 and 3000 poises, preferably between 1500 and 2500 poises.

The sparingly cross-linked polybutylene terephthalate component is cross-linked with one or more polyfunctional compounds containing 3 or 4 ester-forming groups, and preferably containing from 3 to about 14 carbon atoms. Among suitable cross-linking compounds are triols or tetrols, such as, for instance, trimethylol propane, trimethylol ethane, pentaerythritol, glycerine, and the like; triacids or tetracids and their anhydrides, such as, e.g., trimesic acid, trimellitic acid, trimellitic anhydride, pyromellitic acid, pyromellitic anhydride; polyphenols, such as, e.g., phloroglucinol, hydroxyhydroquinone, and the like; amino acids and acid-alcohols, such as, e.g., hydroxyisophthalic acid, aminoisophthalic acid, and the like. The amount of cross-linking agent used will normally be about 0.20 to about 0.60 mole percent, based on the number of terephthalic acid units in the polymer, and preferably is about 0.30 mole percent.

The sparingly cross-linked polybutylene terephthalate component must have a molten state viscosity VF of at least 2000 poises at 260° C., and preferably higher than 4000 poises. There is no significant upper limit of the molten state viscosity VF of the polybutylene terephthalate polymer, and such viscosity can be 10,000 or 12,000 or even higher. Normally, the crimp properties improve as the molten state viscosity VF of the sparingly cross-linked polybutylene terephthalate component increases.

BRIEF DESCRIPTION OF THE DRAWINGS

The invention will be understood more clearly with reference to the accompanying drawing, wherein

In FIG. 1, the side-by-side bicomponent filament of the present invention is illustrated, wherein A represents the sparingly cross-linked polybutylene terephthalate polymer, and B represents the polyethylene terephthalate polymer. It will be noted that the polyethylene terephthalate polymer partly envelopes the sparingly cross-linked polybutylene terephthalate polymer.

In comparison, FIG. 2 illustrates a side-by-side bicomponent polyester filament, obtained by the working examples of the aforesaid U.S. Pat. No. 3,973,073 in which the arrangement of polymer A and polymer B is reversed, with the sparingly cross-linked polybutylene terephthalate partly enveloping the polyethylene terephthalate.

Figure 1:
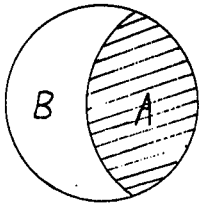
FIG. 1 represents a cross-section of the side-by-side bicomponent filament of the present invention.
Figure 2:
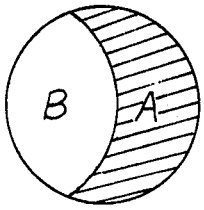
Fig 2 (PRIOR ART)
FIG. 2 represents a prior art side-by-side bicomponent filament.

The arrangement of polymers A and B as shown in FIG. 1 is particularly favorable since the sparingly cross-linked polybutylene terephthalate polymer (A), exhibiting the highest shrinkage, is surrounded by the polyethylene terephthalate polymer (B). This results in increased crimp properties.

Figure 3:
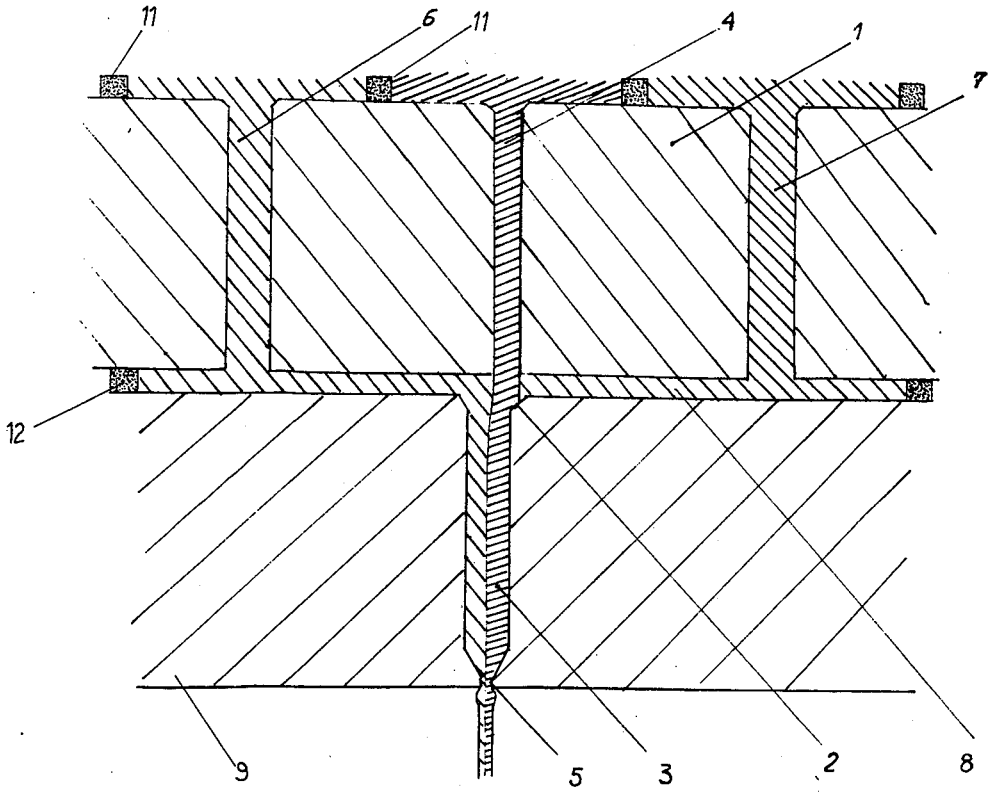
FIG. 3 illustrates in cross-section the spinneret assembly, including spinneret plate and distribution plate, which can be used in the process of the present invention.

The filaments of the present invention can be produced, by the special process described herein, preferably using the apparatus of FIG. 3. The dry polymers are each separately melted, either in melters, or in extruders, with the polyethylene terephthalate generally melted at a temperature between 275° and 300° C., and the sparingly cross-linked polybutylene terephthalate generally melted at a temperature of between 255° and 265° C. The polymers are separately metered, conveniently by metering pumps, to a so-called spinning assembly. The respective proportions of the polymers can vary between 80–20% and 20–80% by weight. Preferably, the polymers are used in about equal amounts (50 weight percent of each). The polymers are simultaneously extruded through the same orifice by means of a spinneret assembly such as schematically illustrated in FIG. 3.

FIG. 3 is a cross-sectional view of a spinneret head assembly which can be used in the process according to the present invention. The sparingly cross-linked polybutylene terephthalate, in the molten state, is passed through channel 4 of distribution plate 1, and then is directed by chamfer 2 of bore 3 through bore 3 and through orifice 5 to the atmosphere. The polyethylene terephthalate component is passed through distribution plate through channels 6, 7, and flows through space 8 between the distribution plate 1 and spinneret plate 9 to bore 3, wherein the polyethylene terephthalate envelopes the sparingly cross-linked polybutylene terephthalate totally and eccentrically. The polymers then pass through bore 3 and orifice 5 to the atmosphere.

It will be noted that seals 11 are used to separate the polymers from each other until they have passed through distribution plate 1.

As will be readily apparent from examination of FIG. 3, channel 4 through distribution plate 1 has a diameter which is less than the diameter of bore 3, and channel 4 and bore 3 are not coaxial. The axis of channel 4 can be farther offset from the axis of bore 3 if the stream of molten sparingly cross-linked polybutylene terephthalate is impinged upon a chamfer 2 provided at the entrance to bore 3. The dimensions of the chamfer are increased as the displacement of the axis of the channel 4 from bore 3 is increased. In any event, with increased displacement of the axes, it is important to provide a means for the stream of sparingly cross-linked polybutylene terephthalate to flow normally along a part of the wall of bore 3. Normally, and preferably, the channel 4 and bore 3 overlap along the axial direction. Channel 4 may only overlap chamfer 2, or, the channel 4 may overlap bore 3 inside of chamfer 2.

The spinneret orifice 5 can have different cross-sections, as is known to those skilled in the art. For instance, the cross-sections can be round, elongated, eliptical, or even multilobal.

In the process described above, using the apparatus schematically represented by FIG. 3, it has been found that particularly good results are obtained using spinneret orifices having round cross-sections. For the case of such round cross-sections, the orifice diameter will normally be within the range of 0.20 to 0.90 mm, although the orifice diameter will vary with the nature of the desired final product, as will be clear. The number of the orifices is unlimited, and thus it is possible to realize a wide range of counts at quite variable spinning speeds, for instance, from 200 to 4000 meters per minute, or even higher. After spinning, the filaments are drawn as is normal according to conventional processes, in either a continuous or discontinuous manner, at ratios which will generally be between 1.2× and 5×, and at speeds which can vary quite widely, for instance between 500 and 4000 meters per minute.

The filaments can then be subjected to crimp development, using steam or hot air, in the absence of tension on the filaments, to develop a helical crimp which is characteristic of bicomponent filaments. The crimp properties of the yarns of the present invention are excellent in all respects, and in particular the crimp frequency, half uncrimping force and half recrimping force, as well as the modulus of elasticity, are greatly improved over the properties of prior art filaments. If the filament of the present invention exhibits too high a shrinkage in boiling water, the shrinkage can be lowered using conventional techniques, which may result in some reduction of crimp properties.

It will be readily appreciated, from examination of FIG. 1 of the accompanying drawing, that the structure of the filaments of the present invention is such that the polyethylene terephthalate polymer is crescent shaped in cross-section, and the sparingly cross-linked polybutylene terephthalate polymer lies inside of the crescent.

The preferred cross-linking agent in the sparingly cross-linked polybutylene terephthalate is trimethylol propane, which is preferably used in an amount of 0.3 – 0.4 mole percent, based on the number of terephthalic acid units in the polybutylene terephthalate polymer.

During melt spinning, the spinneret assembly, or at least the orifices thereof, are maintained at a temperature of about 260° to about 285° C. It is unnecessary to use shrinkage agents in a bath at the exit of the spinneret orifices, as the extruded filament can be simply cooled in an air current as it leaves the spinneret assembly.

The characteristics of the crimp may be modified, as known to those in the art, by varying the stretching conditions and also by varying subsequent treatment, such as overstretching, thermal fixation under tension, or in the relaxed state, and boiling water treatment while in the relaxed state.

The bicomponent filaments of the present invention can be utilized in the manufacture of fabrics, either woven or knit, rugs and the like, but are particularly useful in the field of hosiery, wherein the resulting hosiery products have excellent wear properties.

Dimensions of various parts of the spinneret assembly such as bores and channels diameters and spaces between distribution plate and spinneret are not significantly different from those ordinarily used and depend more specially on viscosities and flows of the two polymers to be spun and on the desired count for the resulting filaments. They also depend on the spinneret shape (round, rectangular, elliptic and so on), and on the piercing plan chosen, i.e., orifices pierced along one or several circles or rows or groups of them, each group forming for example a V, Y or star shape and so on. Generally speaking they depend on the used spinning technology and can be easily determined by the skilled man by means of simple tests.

EXAMPLES OF THE INVENTION

The present invention will be understood more clearly with reference to the following examples, which are presented to illustrate, but not to limit, the invention.

The melted state viscosity VF of the polymers, expressed in poises, is measured on a Davenport Extrusion Plastometer.

The extensibility E is expressed by the formula $E = (L - 1)/l \times 100$, in which $L$ represents the length of the uncrimped fiber under a tension of 250 mg/dtex and $l$ represents the length of the crimped fiber without tension.

Starting with the elongation-force curve established for the interval of l to L, the half-uncrimping forces and the half-recrimping forces can be read from the ordinate for the corresponding point of E%/2 on the abscissa.

The frequency of crimping is expressed in the number of half-undulations or half-crimps per centimeter of uncrimped fiber.

EXAMPLES 1 – 3

4 lots of different polymers were prepared, as follows:

Polymer A

Polyethylene terephthalate having a 0.66 intrinsic viscosity (measured on a 25° C. solution in orthochlorophenol containing 1% by weight per volume of polymer) and having a molten state viscosity VF of 2300 poises at 290° C.

Polymer B

Poly (butylene terephthalate) cross-linked by trimethylol propane in an amount of 0.3 mole percent, based on the amount of terephthalic acid units in the polymer, having a molten state viscosity VF of 4000 poises at 260° C.

Polymer C

Poly(butylene terephthalate) cross-linked by trimethylol propane in an amount corresponding to 0.3 mole percent, based on the number of terephthalic acid units in the polymer, having a molten state viscosity VF of 8000 poises at 260° C.

Polymer D

Poly(butylene terephthalate) cross-linked by trimethylol propane in an amount of 0.3 mole percent, based on the terephthalic acid units in the polymer, and having a molten state viscosity VF of 10,000 poises at 260° C.

The polymers were separately melted, with polymer A melted at 280° C. and polymers B, C and D melted at 245° C. Then bicomponent filaments were spun from polymer couples A-B, A-C and A-D, in proportions of 50% by volume of polymer A and 50% by volume of polymers B, C, or D, respectively. The polymers were spun at 275° C. through a spinneret of the type illustrated in FIG. 3, wherein channel 4 had a diameter of 1.5 mm, bore 3 had a diameter of 2.5 mm, channels 6,7 had a diameter of 2.5 mm, the axis of channel 4 was displaced from the axis of bore 3 a distance of 1 mm, chamfer 2 had a length of 0.75 mm, and the space 8 between distribution plate 7 and spinneret plate 9 was 1 mm. The spinneret had 32 spinning orifices therein, with each orifice having a diameter of 0.50 mm.

The extruded bicomponent filaments were passed over delivery rollers at a speed of 550 meters per minute and maintained at a temperature of 90° C., and then passed over drawing rollers which were maintained at a speed of 2190 meters per minute, producing a draw ratio of about 4. The filaments were then wound up at a speed of 2000 meters per minute, and then steam relaxed (at a pressure of 10 bars) at a temperature of 160° C. In each of Examples 1, 2 and 3, the resulting filaments had a bicomponent structure wherein the polyethylene terephthalate component covered from 50 to 70% of the periphery of the sparingly cross-linked polybutylene terephthalate component.

The characteristics of the resulting filaments are set forth in Table 1 hereinafter.

EXAMPLES 4-C, 5-C and 6-C (Comparison Examples)

For comparison, the polymer couples A - B, A - C and A - D were spun in accordance with Examples 1 – 3 above, but in place of the assembly described in FIG. 3, these comparative examples involved an assembly according to FIG. 1 of U.S. Pat. No. 2,386,173, wherein the spinneret had 32 round orifices each 0.34 mm in diameter. The characteristics of the yarns obtained after the same type of steam relaxation as used in Examples 1 – 3 are set forth in Table I below.

| Examples | 1 | 2 | 3 | 4-C | 5-C | 6-C |
|---|---|---|---|---|---|---|
| Polymer Couple | A-B | A-C | A-D | A-B | A-C | A-D |
| Crimp Frequency | 16,3 | 20,3 | 26,3 | 14,9 | 15,7 | 19,1 |
| Extensibility (%) | 7 | 10,7 | 22,5 | 12,3 | 15,6 | 27,9 |
| Half-Uncrimping Force (mg/tex) | 141 | 214 | 310 | 68,5 | 86,3 | 122 |
| Half-Recrimping Force (mg/tex) | 104 | 158 | 185 | 51,7 | 60,9 | 70 |
| Modulus (g/tex) | 168 | 207 | 212 | 162 | 184 | 185 |

The above table illustrates that yarns produced according to the present invention exhibit better crimp frequencies, and especially much higher half-uncrimping force values and half-recrimping force values, as a result of the filament crimp being more stable than the crimp of the comparative filaments.

In the above examples, the trimethylol propane could be replaced by an equivalent amount of pentaerythritol, trimellitic acid, pyromellitic anhydride, and the like, with similar results.

What is claimed is:

1. Side-by-side bicomponent polyester filaments having improved crimp properties, said filament of two polymers, wherein one polymer (B) is polyethylene terephthalate and the other polymer (A) is sparingly cross-linked polybutylene terephthalate having at least about 0.20 mole percent of trifunctional or tetrafunctional ester-forming crosslinking agent, based on the terephthalic acid content of the polybutylene terephthalate, said other polymer (A) having a melted state viscosity VF of at least about 2000 poises at 260° C., wherein in cross-section said one polymer (B) envelopes said other polymer (A) to an extent such as to cover, at least about 45% of the periphery of said other polymer (A).

2. Filament of claim 1, wherein the sparingly cross-linked polybutylene terephthalate polymer has a melted state viscosity VF of at least about 4000 poises at 260° C.

3. Filament of claim 1, wherein the polyethylene terephthalate polymer has a melted state viscosity VF of about 1000 to about 3000 poises at 290° C.

4. Filament of claim 1, wherein about 50 to about 70% of the periphery of said other polymer (A) is covered by said one polymer (B).

5. Filament of claim 1, wherein said bicomponent filament is substantially circular in cross-section.

* * * * *